United States Patent [19]

Gritters et al.

[11] Patent Number: 4,573,803

[45] Date of Patent: Mar. 4, 1986

[54] INJECTION NOZZLE

[75] Inventors: Gregory A. Gritters, Indio; Walter E. Nellis, Bermuda Dunes; John L. Featherstone, El Centro, all of Calif.

[73] Assignee: Union Oil Company of California, Los Angeles, Calif.

[21] Appl. No.: 610,332

[22] Filed: May 15, 1984

[51] Int. Cl.[4] ..... B01F 5/04

[52] U.S. Cl. ..... 366/167; 137/890; 137/896

[58] Field of Search ..... 366/167, 173, 150, 168, 366/169, 171, 172, 174, 176, 177, 183; 137/890, 896

[56] References Cited

U.S. PATENT DOCUMENTS

| | | | |
|---|---|---|---|
| 1,124,579 | 1/1915 | Ambursen . | |
| 2,153,938 | 4/1939 | Reed . | |
| 2,461,797 | 2/1949 | Zwicky . | |
| 2,681,216 | 6/1954 | Knecht . | |
| 3,297,305 | 1/1967 | Walden . | |
| 3,734,111 | 5/1973 | McClintock | 137/896 |
| 3,886,973 | 6/1975 | Kinney . | |
| 4,026,527 | 5/1977 | Costen . | |
| 4,114,195 | 9/1978 | Dirksing . | |
| 4,264,212 | 4/1981 | Tookey . | |

*Primary Examiner*—Robert W. Jenkins

*Attorney, Agent, or Firm*—Dean Sandford; Gregory F. Wirzbicki; June M. Bostich

[57] ABSTRACT

A nozzle of especial usefulness for injecting corrosive acids into geothermal brines and the like comprises a substantially straight, tubular injector body and a plurality of pairs of injection tubes connected such that the axial bores of the injection tubes are in fluid communication with the axial bore of the tubular injector body. The injection tubes of each pair extend in radial directions from, and in the same plane normal to, the axis of the tubular injector body. Moreover, all injection tubes are in one of two planes coincident to the axis of the tubular body and all pass through a plane parallel to the axis of the injector body.

21 Claims, 3 Drawing Figures

INJECTION NOZZLE

BACKGROUND OF THE INVENTION

This invention relates to a fluid injector for the introduction, dispersion, and mixing of a first fluid into a second fluid flowing through a conduit. More particularly, this invention relates to a fluid injector for injecting a highly corrosive fluid, such as hydrochloric acid, into a flowing stream maintained at high temperature and pressure, such as a stream of hot geothermal brine, for the purpose of controlling scaling in the brine-handling equipment without the rapid corrosion to the injector and associated conduits usually attendant in the environment of hot acidified brine.

In the course of producing energy from hot geothermal brine streams, it is known to acidify the hot brine to reduce the production of scale in liquid-handling equipment. Because geothermal brines have been confined in reservoir rock at high temperature and pressure for long periods of time, produced brines are supersaturated with scale-forming constituents dissolved from the reservoir rocks. Upon production from the reservoir, the brine undergoes reduction in temperature and pressure sufficient to cause extensive precipitation of scales from the supersaturated liquid, so that the liquid-handling equipment becomes clogged with scale and, over time, can become completely inoperative. Since the deposition of scales is reduced by addition of acid, it is known to acidify brines to control scaling in geothermal liquid-handling equipment. But the acid used to control scaling can attack and severely corrode the injection apparatus and surrounding conduits. Corrosion to the interior of the injector can be minimized by using acid resistant alloys. However, the combination of hot acid and geothermal brine is many times more corrosive to metals than hot acid alone. Contact of acid in hot brine with the exterior of the injector and nearby conduits can result in corrosion so severe as to rapidly destroy liquid handling equipment made from even the most corrosion resistant alloys.

Apparatus used to inject a small fluid stream into a larger fluid stream and to mix the small stream with the larger may depend upon turbulence created by the body of a nozzle in the larger stream. U.S. Pat. No. 4,114,195 to Dirksing, et al. discloses an injector having an elongated body, such as a pipe, mounted through an aperture in the side of a larger conduit transversely to the flow of the larger stream therein. An axial bore through the body of the injector permits introduction and mixing into the additive stream within the injector of a small portion of fluid from the large stream before injection into the large fluid stream. The mixture enters the large stream via openings at each end of a small T-shaped extension having connection with the axial bore and is thereby disbursed into the flowing stream. Additional mixing occurs downstream of the conduit as the result of turbulence in the flowing stream caused by presence of the injector.

A hydrofoil shaped injector may also be used to control the path of the additive once it is introduced into the fluid stream. U.S. Pat. No. 4,026,527 to Costen discloses a hydrofoil-shaped vortex generator which controls dispersion of an effluent into a liquid stream, such as a river. An effluent liquid is ejected through tips extending from the extreme ends of an injector having a T shaped transverse wing-like member shaped as a hydrofoil. Vortices are created by the hydrofoil at its extreme ends in the flowing stream. The effluents from each tip are entrained in the vortical flow. By selectively positioning the vortex-generator, effluents can be carried away from the mixing point by the vortices without mixing into the stream at large. The strength and duration of the vortical flow will depend upon factors such as the lift coefficient of the hydrofoil and the speed and turbulence of the flowing streams. The hydrofoil generator is particularly useful for carrying the additive away from the point of dispersion without mixing it into the larger flowing stream. This type of hydrofoil generator, while useful for preventing backmixing and providing directional flow to the additive, does not disburse the additive in a uniform manner into the fluid stream as would be desired in an injector used to acidify brine. To prevent precipitation of scale from hot brine, the acid must be mixed thoroughly into the brine within a short distance of the point of injection.

U.S. Pat. No. 3,297,305 to Walden combines a static mixing device with an injection nozzle to promote thorough mixing of a chemical into a flowing stream. Disposed within a tubular mixing chamber, such as a conduit containing flow of a large fluid stream, is a plurality of mixing vanes spaced longitudinally within the mixing chamber. Each vane extends radially outward from a central point at an angle sufficient to impart to the larger stream a swirling movement, each mixing vane being arranged to reverse the swirling movement imparted to the flowing stream by the preceding vane. Ahead of the mixing vanes is an injector tube mounted from the side of the conduit which extends transversely as far as the axial midpoint of the mixing chamber. A laterally-extending nozzle directed axially against the intended flow of the larger fluid stream extends from the injector tube. The nozzle is conically shaped and comprises a flexible diaphragm having orifices adapted to deform or stretch in response to increased pressure in the discharge nozzle caused by clogging of dirt or chemical particles. The expandable orifices are self-cleaning, should plugging occur from within. The additive fluid is injected from the nozzle into the flowing stream, and turbulence produced by the vane mixers thoroughly disperses the additive into the larger stream. The nozzle disclosed by Walden, however, is unsuitable for use with a highly corrosive acid. The injected fluid is not disbursed radially away from the nozzle itself to prevent contact of the additive with its exterior. Moreover, since the nozzle injects the additive against the flow of the current, the chemical additive flows across the injection nozzle. If the additive were a highly corrosive acid such as hydrochloric acid used in control of scale from geothermal brine, the concentrated acid would corrode the exterior of the injection nozzle beyond use in a relatively short period of time.

The problems unique to injection of a highly corrosive scale-inhibiting additive into a high temperature geothermal stream therefore are not solved by injection nozzles known in the art. What is particularly needed is an injection nozzle which disburses the corrosive additive away from the nozzle in a uniform manner. Uniform dispersion directed away from the nozzle assures that the nozzle is not subject to rapid corrosion, and that the additive will effectively reduce scaling in the interior of the conduit without excessive corrosion to the walls of the conduit.

SUMMARY OF THE INVENTION

It has now been discovered that corrosion due to injection of acid into a fluid stream, such as a geothermal brine stream, can be substantially reduced or minimized by introducing the acid into the fluid stream using a nozzle comprising a substantially straight tubular injector body having an axial bore therethrough with at least two pairs of substantially straight injection tubes, each having an axial bore therethrough fluid-tightly connected to the axial bore of the injector body. The injection tubes of each pair extend radially in the same plane normal to the axis of the injector body so that each injection tube lies in one of two planes containing the axial bore of the injector body, with each injection tube cutting a third plane parallel to the axial bore of the injector body.

Typically, the injection nozzle is mounted transversely to fluid flow within a conduit containing a fluid stream into which the corrosive fluid is to be added. The tubular injector body extends from an aperture in the side of the conduit along its complete diameter so that the radially extending injection tubes face downstream from the injector body.

In a yet broader embodiment of the invention, there is provided a nozzle, and a method for injecting a first fluid from said nozzle into a second, comprising an injector body for carrying a fluid and a plurality of injection tubes emanating from said injector body for delivering the first fluid into the second. The ends of the injection tubes opposite the injector body are located so that straight lines from each of the ends to the closest point on the injector body all cut through the same imaginary plane. In this embodiment of the invention, the injection tubes and/or injector body need not be straight, and the injection tubes need not be arranged in pairs. It is preferred in this embodiment of the invention, as in all embodiments, that the ends of the injection tubes lie in the same plane and be symmetrical about a point in said plane.

BRIEF DESCRIPTION OF THE DRAWING

The present invention will be more readily understood by reference to the drawings.

DETAILED DESCRIPTION OF THE INVENTION

In producing and utilizing hot pressurized brine solutions which contain dissolved salts at or near their saturation concentrations, if the pressure and/or temperature of the solutions is reduced, a portion of the salts can precipitate and deposit as scale on the surfaces of the vessel or conduit confining the brine. To prevent deposition of scales from geothermal brine, hydrochloric acid is commonly used to reduce the pH of the brine sufficiently to prevent scaling. While other strong acids would be somewhat less corrosive to the metals used for conduits and vessels, hydrochloric acid is the least likely of the commonly used and economically feasible acids to contribute anions to scales forming in the geothermal brines. An acid injection nozzle, therefore, for use in geothermal brines must inject the highly corrosive acid while protecting the nozzle from the effects of the acid. To also prevent corrosion to the conduits carrying the acidified stream, the nozzle should be designed so as to limit contact of un-mixed acid with the walls of the conduit. Since the injection nozzle disburses the acid upon entry into the stream, corrosion damage to downstream equipment, such as a static mixer and downstream conduits, is minimized while scaling is reduced.

Figure 1:
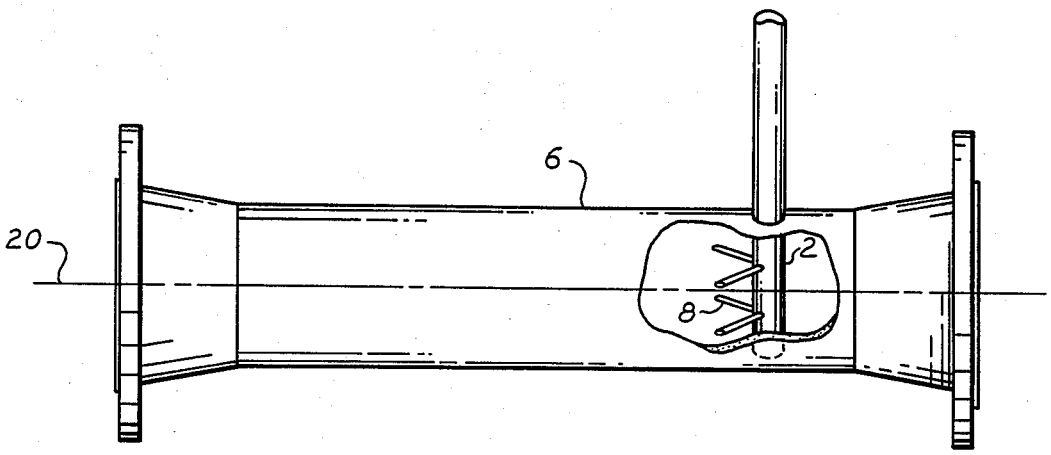
FIG. 1 is an isometric drawing of a conduit having, as shown in a breakaway view, an injection nozzle of the invention positioned therein.

The acid injection nozzle shown in FIG. 1 of the drawing comprises a tubular injector body 2 fluid-tightly mounted through an aperture in the side of conduit 6. The injector body extends transversely to fluid flow in conduit 6 and along its entire diameter so as to present a uniform resistance to the flow of brine.

Figure 3:
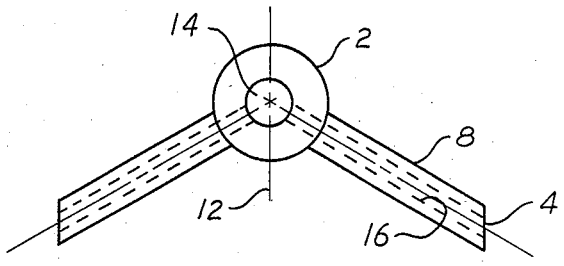
FIG. 3 is a top view looking directly down the axis of the injector body 2. It will be understood that like elements in the figures are referred to by the same reference numerals.
Figure 2:
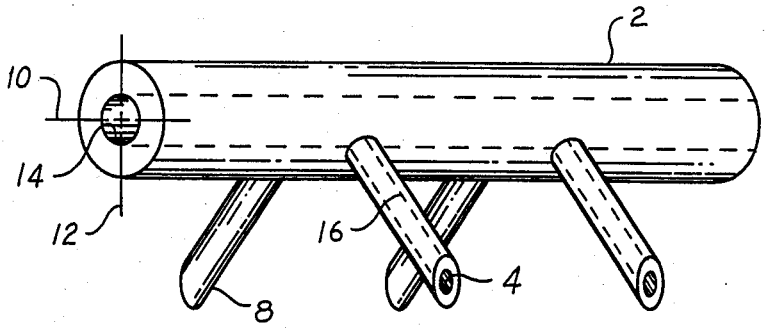
FIG. 2 is an isometric enlargement of the injection nozzle of FIG. 1.

Mounted on the injector body 2 is a plurality of pairs of injection tubes, which tubes extend radially from the injector body at the same downstream angle. In FIGS. 1 and 2, two such pairs are shown, mounted so as to divide that portion of the injector body 2 traversing the inner diameter of conduit 6 into three equal portions. The injection tubes 8 of each pair are in the same plane normal to the axis of the axial bore of injector body 2. The injection tubes 8 are preferably of equal length and have axial bores therethrough which are preferably of equal diameter. Each of the injection tubes is, in the preferred embodiment, substantially straight. An axial bore 14 down injector body 2 is in fluid communication with the axial bores 16 exending down each injection tube and opening at 4 into the interior of conduit 6, which typically has a 6 inch diameter or larger. Each pair of injection tubes extends radially from axis 10 of the injector body and at the same downstream angle from a plane 12 (see FIG. 3) parallel to the direction of flow and containing the axis 10 of injector body 2. The ends of injection tubes 8 preferably are cut in a direction parallel to plane 12 (as shown best in FIG. 3) so that openings at 4 from axial bore 16 into conduit 6 have an elliptical shape. The ends of injection tubes 8 are located so that effluent acids will not be drawn into the zone of slow-moving currents along the sides of conduit 6.

In view of the foregoing discussion, it will be seen (in FIGS. 1 and 3 especially) that the injection tubes 8 all pass through any of a number of imaginary planes running normal to axis 20 of conduit 6 and parallel to the axis of the injector body 2. In addition, when the preferred embodiment is employed, with injection tubes 8 of equal length, the ends of the injection tubes will form a square or rectangle on such an imaginary plane, with the center of said square or rectangle being coincident with the axis 20 of the conduit 6.

Since the velocity profile in a conduit drops to zero at the wall, acid caught in slow moving fluid next to the wall will subject the metal of the conduit to severe corrosion damage. It is, therefore, preferred that the ends of the injection tubes be located so that acid spurting from openings in the injection tubes at a velocity higher than that of the large flowing stream will not approach the walls of conduit 6 and will not be caught in the slow moving flow along the conduit walls, thus avoiding excessive corrosion thereof.

For best results in the preferred embodiment, which uses four injection tubes, the positioning of the injection tubes should be determined in relation to the distance between their ends and the walls of the conduit housing the nozzle. The body of the acid injection nozzle is preferably located symmetrically with respect to the interior of the conduit. In a preferred embodiment, the four ends of the radially extending arms 8 form a rectangle, most preferably a square, on a plane normal to the axis of conduit 6, with the closest distance between the interior surface of the conduit and the end of a radially extending arm being less than the smallest distance between any two ends of the four radially extending arms but greater than 75 percent of that smallest distance.

It will be understood that reduction of corrosion through use of the nozzle of the present invention will be dependent upon several factors. One such, as just discussed, is the angles the several injection tubes make as measured from plane 12. Another is the diameter of conduit 6, another the relation of the velocity of fluid and flow rate in conduit 6 to the velocity and flow rate of the acid injected from injection tubes 8, another the relation of the cross-sectional area of the injection nozzle to that of fluid conduit 6 and still another the length of injection tubes 8. In any particular application, it will be necessary to consider each of these factors and to design the nozzle to ensure that the acid is injected far enough downstream of injector body 2 to prevent corrosion, with the points of injection being sufficiently spaced from the walls of conduit 6 so as to avoid substantial corrosion thereof.

The downstream angle of the injection tubes 8 (as measured between said tubes and plane 12) is preferably adjusted to suit the velocity of the fluid flow in conduit 6. At higher fluid velocity, a higher angle is used, up to a maximum of about 60 degrees. At lower fluid velocities, a lower angle is used, down to a minimum in the range of about 10 to 20 degrees. Typically, when the velocity of fluid in conduit 6 is less than 3 feet per second, an angle between the injection tubes and plane 12 of less than 45 degrees is suitable. Angles greater than 60 degrees often result in acid being caught in the slow moving currents along the pipe walls with resulting pipe corrosion. Based upon the above limitations upon the downstream angle, a length for the injection tubes can be found such that the ends of the tubes will be located within the prescribed distance of the wall of conduit 6.

The velocity of acid exiting the injection tubes is also determined in relation to the velocity of the fluid in conduit 6. Typically, axial bores 14 and 16 are sized so that the effluent acid streams from openings at the ends of injection tubes 8 have a velocity of from about 3 to 5 times the velocity of the fluid in conduit 6.

To minimize the turbulence caused by introducing the nozzle into conduit 6, the total cross-sectional area of the injection nozzle, including the tubular arms 8 and injector body 2, as presented against the flow of the brine stream in conduit 6, preferably does not exceed 20 percent of the inner cross sectional area of conduit 6 as measured normal to the axis 20 of conduit 6.

In operation, the acid injection nozzle of the present invention is used to inject a smaller liquid stream of a highly corrosive strong acid into a larger flowing stream of liquid, such as hot, pressurized geothermal brine, flowing within a cylindrical conduit such as a pipe having a 6 inch diameter or larger. In the preferred embodiment, the acid injection nozzle prevents, minimizes, or substantially reduces corrosion to the exterior of the nozzle by introducing the corrosive acid into the larger stream of brine through a plurality of injection tubes which extend a radially equal distance from the axis 10 of injector body 2, which axis intersects perpendicularly the axis of the conduit containing the larger brine stream. The acid enters the stream of hot brine at a velocity greater than that of the brine stream to prevent acid from being trapped into eddy currents that form behind each injection tube. Size and positioning of the injection tubes is determined with reference to the size of the brine conduit and the velocity of the stream into which the additive is injected.

The brine stream then carries the small streams of acid away from their points of entry without backflow of acid upon the exterior of the injection nozzle or along conduit walls due to the turbulence-free design of the injection nozzle. At a point downstream of the injection nozzle, turbulence created by the flowing stream or by use of a conventional static mixer (not shown) uniformly mixes the acid into the brine to accomplish uniform reduction of pH throughout the brine.

EXAMPLE 1

With reference to the tubular injection nozzle as shown in FIG. 2, an acid injection nozzle is constructed for use in a 10 inch diameter pipe (of exactly 10.13 inch inner diameter). Tubular injector body 2 has an outside diameter of 1.125 inches and an axial bore of $\frac{5}{8}$ inch diameter. Two pairs of injection tubes 8 divide the length of injector body 2 into 3 equal portions of 3.38 inches in length.

The four acid injection tubes have an outside diameter of $\frac{3}{8}$ inch and an axial bore of 0.20 inch diameter and extend radially a distance of 1.7 inches from their jointure with the surface of injector body 2. The bisected angle between a pair of injection tubes is 45 degrees.

The acid nozzle is fabricated from Hastelloy B-2 corrosion inhibiting alloy to minimize corrosion and the injection nozzle assembly is mounted within the 10 inch diameter conduit so that the ends of injection tubes 8 form a square of 3.38 inches on a side in a plane vertical to the axis of the brine conduit, the ends being 2.68 inches from the inside surface of the 10 inch diameter brine conduit as measured along the plane.

The velocity of fluid within the brine conduit is 4 feet per second, and the velocity of acid leaving from the ends of injection tubes 8 is 20 feet per second so that the acid exits the ends of injection tubes 8 at a velocity 5 times that of the fluid in conduit 30.

Although the invention has been described in conjunction with specific embodiments thereof, it is evident that many alternatives, modifications, and variations will be apparent to those skilled in the art in light of the foregoing description. For example, although the drawing shows injection tubes 8 as straight tubes, it should be apparent that in one modification of the invention these tubes may be curved or even of irregular shape, so long as the ends of the tubes terminate downstream from the injector body and are spaced from each other so that corrosion is minimized. In one embodiment of this modification, the injection tubes are curved or of irregular shape, but terminate in ends which, as in the preferred embodiment, form a square or rectangle on a plane normal to the axis of the conduit, with the center of the square or rectangle being coincident with the axis of the conduit 6. Accordingly, it is intended to embrace all such alternatives, modifications, and variations as fall within the spirit and broad scope of the appended claims.

We claim:

1. A nozzle useful for injecting a corrosive fluid into a fluid stream comprising:
(a) a substantially straight tubular injector body having an axial bore therethrough; and
(b) at least two pairs of substantially straight injection tubes having axial bores therethrough fluid tightly connected to the axial bore of the injector body, the injection tubes of each pair proceeding radially from, and in the same plane normal to, the axis of the injector body, and with each of the injection tubes lying in one of two planes containing the axis of the injector body, which injection tubes cut a third plane parallel to the axial bore of the injector body.

2. A nozzle as defined in claim 1 wherein the injection tubes are of substantially equivalent length.

3. A nozzle as defined in claim 1 wherein the injection tubes of each pair are in planes normal to the axis of the injector body, and the normal planes divide the tubular injector body into substantially equal portions.

4. A nozzle as defined in claim 1 wherein the nozzle is fabricated from a corrosion resistant alloy.

5. A nozzle as defined in claim 1 wherein the angle between the two planes containing the injection tubes and the axis of the injector body is bisected by a fourth plane containing the axial bore of the injector body such that the angle between any one of the two planes and the fourth plane is between about 20 and 60 degrees.

6. A nozzle as defined in claim 5 wherein the ends of the injection tubes are cut parallel to the fourth plane which bisects the angle between the two planes containing the injection tubes and the axis of the injector body.

7. A nozzle as defined in claim 1 wherein the ends of the injection tubes form a square lying upon a fifth plane parallel to the axis of the injector body, with the center of the square and the midpoint of the injector body defining a line perpendicular to both the fifth plane and the axis of the injector body.

8. A nozzle as defined in claim 1 wherein two pairs of injection tubes are positioned along the injector body so as to divide the tubular injector body into three substantially equal portions.

9. A mixing apparatus comprising in combination:
(a) a cylindrical conduit for carrying a liquid; and
(b) a nozzle within said conduit comprising:
(1) a substantially straight tubular injector body mounted within said conduit and traversing an entire inner diameter of said conduit, said injector body having an axial bore, the axis of which is coincident with said diameter, the tubular injector body opening in at least one of its ends to a location exterior to said conduit; and
(2) at least two pairs of substantially straight injection tubes having axial bores therethrough fluid-tightly connected to the axial bore of the injector body, with the injection tubes of each pair proceeding in a radial direction from, and in a plane normal to, the axis of the injector body, and with each of the injection tubes lying along one of two planes coincident with the axial bore of the injector body, which injection tubes cut a third plane parallel to the axial bore of the injector body.

10. A mixing apparatus as defined in claim 9 wherein the cylindrical conduit for carrying a liquid is no less than 6 inches in diameter.

11. A mixing apparatus as defined in claim 10 wherein the ends of the injection tubes are cut parallel to a plane normal to the fourth plane which bisects the two planes containing the injection tubes and the axis of the injector body.

12. A mixing apparatus as defined in claim 9 wherein two pairs of injection tubes are in planes normal to the axis of the injector body, and the normal planes divide the tubular body into substantially equal proportions.

13. A mixing apparatus as defined in claim 9 wherein the angle between the two planes containing the injection tubes and the axis of the injector body is bisected by a fourth plane also containing the axial bore of the injector body such that the angle between any one of the two planes and the fourth plane is between about 20 to 60 degrees.

14. A mixing apparatus as defined in claim 9 wherein the nozzle is fabricated from a corrosion resistant alloy.

15. A mixing apparatus comprising in combination:
(a) a cylindrical conduit for carrying a liquid; and
(b) a nozzle within the conduit comprising:
(1) a substantially straight tubular injector body mounted within the conduit and traversing an entire inner diameter of the conduit, the injector body having an axial bore, the axis of which is coincident with the diameter, at least one end of the tubular injector body opening to a location exterior to the conduit; and
(2) at least two pairs of substantially straight injection tubes of substantially equal length and having axial bores of substantially equal diameter therethrough, which axial bores of the injection tubes are fluid-tightly connected to the axial bore of the injector body, with the injection tubes of each pair proceeding in the radial direction from, and in a plane normal to, the axis of the injector body, cutting a plane parallel to the axial bore of the injector body, and terminating within the interior of the conduit, said injection tubes forming an angle as measured from a plane containing the axis of the conduit and the axis of the injector body between 25 and 60 degrees, with the closest distance between an end of an injection tube and the inside surface of the conduit being less than the smallest distance between the ends of any pair of injection tubes but not less than 75 percent of that smallest distance.

16. The mixing apparatus of claim 15 wherein the pairs of injector tubes are connected to the injector body so as to divide the inner diameter of the conduit into equal portions.

17. The mixing apparatus of claim 15 wherein the end of each injection tube is the same distance from the closest point on the inner surface of the conduit.

18. The mixing apparatus of claim 15 wherein the ends of the injection tubes form a square in a plane normal to the axis of the conduit, the center of the square being on the axis of the conduit.

19. The mixing apparatus of claim 18 wherein the ends of the injection tubes are cut parallel to the plane containing the axis of the conduit and the axis of the injector body.

20. A mixing apparatus comprising:
(a) a cylindrical conduit for carrying a liquid and
(b) a nozzle within said conduit comprising:
(1) a substantially straight tubular injector body having an axial bore therethrough; and
(2) a plurality of injection tubes emanating from the injector body, the injection tubes being in fluid communication with the injector body and the ends of the injection tubes being arranged to lie in the same plane normal to the axis of said conduit.

21. A mixing apparatus as defined in claim 20 wherein said ends of said injection tubes are arranged substantially symmetrically in said plane about the axis of said conduit.

* * * * *